United States Patent [19]

Shima et al.

[11] Patent Number: 5,063,755

[45] Date of Patent: Nov. 12, 1991

[54] FABRIC PRESSER FOR V-BED FLAT KNITTING MACHINE

[75] Inventors: Masahiro Shima; Toshinori Nakamori, both of Wakayama, Japan

[73] Assignee: Shima Seiki Mfg. Ltd., Wakayama, Japan

[21] Appl. No.: 527,560

[22] Filed: May 23, 1990

[30] Foreign Application Priority Data

Jun. 2, 1989 [JP] Japan ..... 1-140645

[51] Int. Cl.[5] ..... D04B 15/28

[52] U.S. Cl. ..... 66/90; 66/64

[58] Field of Search ..... 66/64, 147

[56] References Cited

U.S. PATENT DOCUMENTS 3,685,317 8/1972 Giachetti et al. ..... 66/64

4,442,683 4/1984 Shima et al. ..... 66/64

FOREIGN PATENT DOCUMENTS 1043568 11/1958 Fed. Rep. of Germany ..... 66/64

2112026 7/1983 United Kingdom ..... 66/64

*Primary Examiner*—Werner H. Schroeder

*Assistant Examiner*—John J. Calvert

*Attorney, Agent, or Firm*—Barnes, Kisselle, Raisch, Choate, Whittemore & Hulbert

[57] ABSTRACT

A fabric presser for use with a V-bed flat knitting machine. The fabric presser includes an elongate presser bar supported on the end of a presser bar arm which is mounted for a rocking motion. The presser bar may be moved in the rocking motion toward and away from needle beds of the knitting machine and these beds have a space between them to allow entry of the presser bar. A reversible motor is associated with the pressure bar supporting arm to move the presser bar into and out of the spaced needle beds. First and second proximity sensors are provided to detect whether the presser bar is advanced into the range for a knitting operation or is retracted into a range for a knitting operation.

5 Claims, 2 Drawing Sheets

FABRIC PRESSER FOR V-BED FLAT KNITTING MACHINE

FIELD OF THE INVENTION

This invention relates to a stitch presser for a V-bed flat knitting machine.

RELATED ART STATEMENT

In a V-bed flat knitting machine wherein two needle beds are placed in an inverted V-shaped configuration with top portions thereof opposed to each other, a knit fabric knit by needles of the opposed needle beds is suspended below the needle beds from a needle bed spacing portion between the top portions of the two needle beds in a condition wherein it is held on piano wires extending in a longitudinal direction of a machine frame through sinker plates provided at the top portions of the two beds. Such knit fabric is held at loops of a top end portion thereof on the needles, and positions of the loops held on the needles are adjusted by pulling down the knit fabric by means of the weight of a weight or a fabric take-up device or the like. Such adjustment, however, is not easy because the adjustment of the weight is difficult due to the fact that the knit fabric has elasticity and the fabric pulling down force is varied in accordance with a winding diameter.

Thus, various stitch pressers have been developed which are each inserted into the needle bed spacing portion of the needle beds to directly press down a portion of a knit fabric adjacent loops held on needles into the needle bed spacing. Every one of those stitch pressers is normally constituted such that it is placed on a carriage which is supported by guide rails and moved back and forth on upper faces of the needle beds and is advanced, when the carriage is moved in a predetermined direction, into the needle bed spacing portion to press against the knit fabric, but when the carriage is moved in the reverse direction, it is moved away from the needle bed spacing while another stitch presser provided for the movement of the carrier in the opposite direction is advanced into the needle bed spacing portion. Such movement of a stitch presser into and away from the needle bed spacing portion is achieved such that movement of a cam plate provided on the carriage is transmitted to the stitch presser by way of a cam follower provided on an arm of the stitch presser, and the cam plate is moved when it collides with an abutment lever supported outside the carriage at each of the opposite ends of reciprocating movement of the carriage. To this end, the carriage must be moved back and forth over the entire length of the machine frame in order for the cam plate on the carriage to collide with the abutment levers outside the carriage irrespective of a knitting width of the knit fabric. Accordingly, when attention is paid to movement of the carriage, in case the knitting width is small, movement of the carriage includes, at the opposite end portions thereof, considerable wasteful back and forth movement in which no knitting operation is performed.

Further, since advancement of the stitch presser into the needle bed spacing is performed by collision of the cam plate with an abutment lever, the advanced position of the stitch presser, that is, the pressed down amount of a portion of the knit fabric adjacent loops held on the needles, is determined in a predetermined positional relationship of the cam plate to the abutment lever. Accordingly, the advanced position (pressed down amount) of the stitch presser into the needle bed spacing must be adjusted every time by a manual operation of an operator by itself in accordance with various knitting parameters including a yarn tension and a type of a yarn and a texture and so forth of each of various existing knit fabrics, which is very cumbersome.

Also in a multi-system flat knitting machine having two or more knitting systems, since changing over of stitch pressers provided for the individual knitting systems are performed simultaneously by movement of a series of cam plates provided on a carriage, it is impossible to individually render the stitch pressers for the knitting systems operative or inoperative, and consequently, several of the stitch pressers may sometimes cause excessive pressing down to impose a burden on the knit fabric.

OBJECT AND SUMMARY OF THE INVENTION

An apparatus of the present invention is provided in order to make it possible, taking the point described above into consideration, to perform changing over of stitch pressers at the opposite ends of back and forth movement of a carriage even when the length of back and forth movement of the carriage is made smaller than the overall length of needle beds in accordance with a width of a knit fabric and to suitably vary the pressing down amount of the stitch pressers.

A fabric presser for a V-bed flat knitting machine comprises a presser bar, a presser bar supporting arm having the presser bar at an end thereof, a support member having the presser bar supporting arm supported for rocking motion by way of a rocking member such that the presser bar may be moved toward and away from a needle bed spacing portion of the knitting machine, and a motor mounted on the supporting member for rocking the rocking member.

The carriage is reversed at each end portion of a knit fabric to continue a knitting operation in accordance with a knitting width of a knit fabric to be knit irrespective of a maximum knitting length of the knitting machine.

When the carriage reaches a knitting end portion of the knit fabric, the motor for moving back and forth the presser bar supporting member on which a stitch presser is supported is rendered operative so that a stitch presser which is directed in a direction in which the carriage is to knit after such reversal is advanced toward the needle bed spacing portion while another stitch presser directed in the already knit direction is advanced and retracted simultaneously.

Such operation of the motor as described above is stored in advance in a storage member such that it may be synchronized with a width of a knit fabric to be knit and is performed when knitting of the knit fabric of a predetermined width is completed and the carriage is reversed.

BRIEF DESCRIPTION OF THE DRAWINGS

The drawings show an embodiment of the present invention.

DETAILED DESCRIPTION OF PREFERRED EMBODIMENTS

Figure 1:
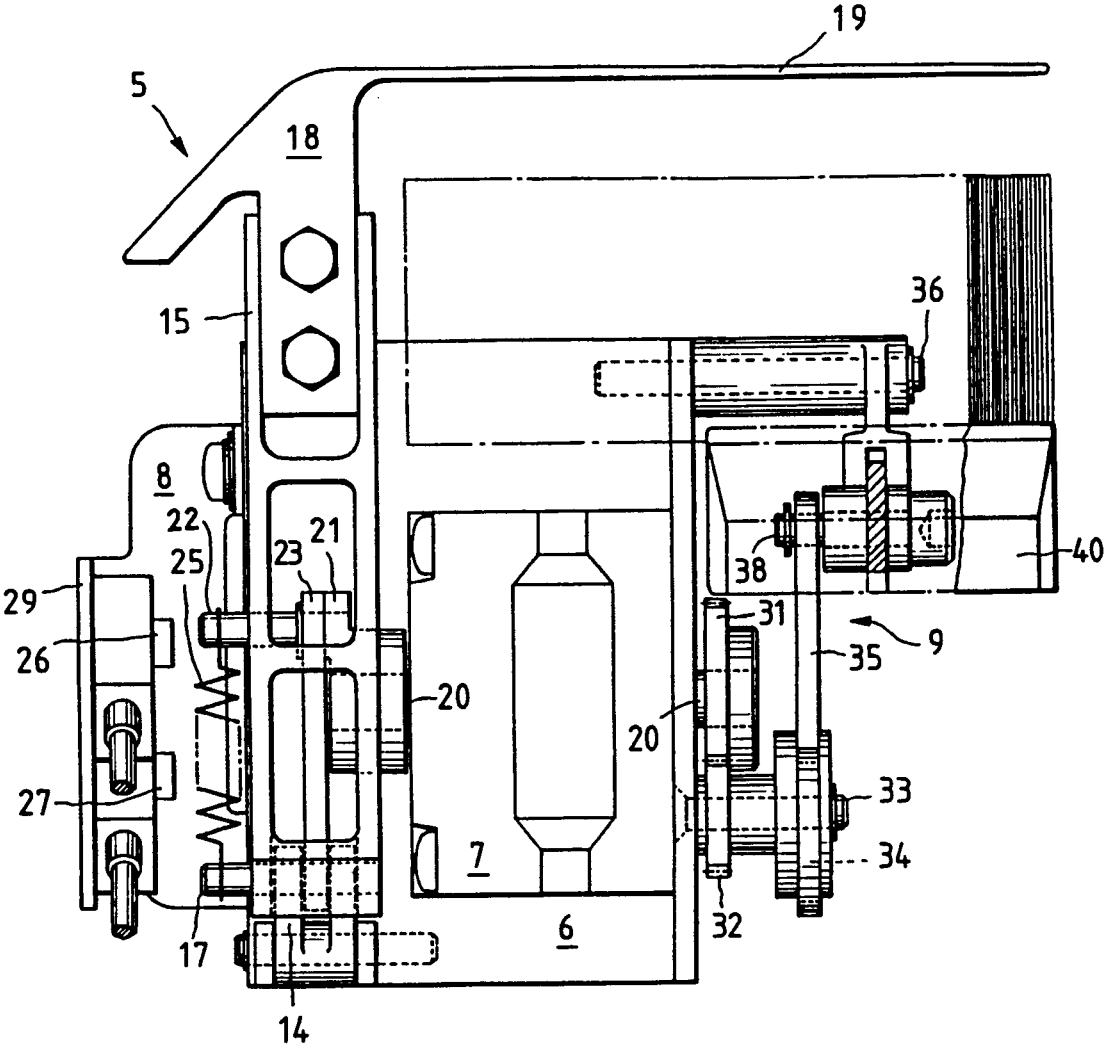
FIG. 1 is a plan view.

An embodiment of an apparatus of the present invention will be described subsequently with reference to the drawings.

A stitch presser 5 of the present invention is provided on a carriage 4 (shown in FIGS. 2 and 3) supported for movement by means of suitable guide members such as guide rails on upper faces (only one is shown in the example shown) of two needle beds 3, 3 which are provided in an inverted V-shaped configuration such that top portions 1, 1 are opposed to each other with a gap of a needle bed spacing portion 2 left therebetween. The stitch presser 5 is constituted in the following manner.

Reference numeral 6 denotes a base plate for the stitch presser 5, and a motor 7 is provided on an upper face of the base plate 6 while a presser bar supporting member 8 and a brush supporting member 9 are provided on the opposite sides of the base plate 6.

The presser bar supporting member 8 is constituted in the following manner. A presser bar supporting arm 15 is supported for pivotal motion by means of shafts 16, 17 at ends of rocking arms 13, 14 which are supported at the opposite ends of a projecting member 10 on the base plate 6 by means of shafts 11, 12. The presser bar supporting arm 15 is moved back and forth perpendicularly from a side to a center line of the needle bed spacing portion 2 of the needle beds 3, 3 by rocking motion of the rocking arms 13, 14. A presser bar 18 having an end bent in an L-shape is secured to an end of the presser bar supporting arm 15 such that a straight portion 19 of the presser bar 18 may be moved into and out of the needle bed spacing portion 2 by movement of the presser bar supporting arm 15 toward and away from the needle bed spacing portion 2. In order to move the presser bar supporting arm 15 back and forth, a rod 23 supported for pivotal motion at 22 on a crank arm 21 of a motor shaft 20 is connected to the shaft 17 of the rocking arm 14. A fitting portion of the rod 23 on the shaft 17 has an elongated hole 24 formed therein so as to provide a loose condition, and a spring 25 is interposed between the shaft 17 and the shaft 22 to exert a damping action.

Proximity sensors 26, 27 are provided by way of a support plate 29 at locations opposing to a locus of rotation of the shaft 22 provided at an end portion of the crank arm 21 by rotation of the crank arm 21. It is detected by the sensor 26 whether the presser bar 18 is advanced into an appropriate range for a knitting operation, and it is detected by the sensor 27 whether the presser bar 18 is retracted into an appropriate range for a knitting operation. Those elements make an action of a safety device, and if the shaft 22 is positioned such that it is not detected by either one of the sensors 26, 27, that is, if the presser bar 18 is positioned at an intermediate position which does not coincide with the advanced position nor with the retracted position, a stop motion operates so that the machine is stopped. An arbitrary position from a shallowest position 22*a* (corresponds to a position for the transfer and a position just below on the back side of needles) to a deepest position 22*b* at which the shaft 22 can be detected by the sensor 26 can be obtained by varying the number of pulses of a stepping motor. By such variation of the position, the advanced position of the presser bar 18 can be varied within a range indicated by X in FIG. 2.

Figure 2:
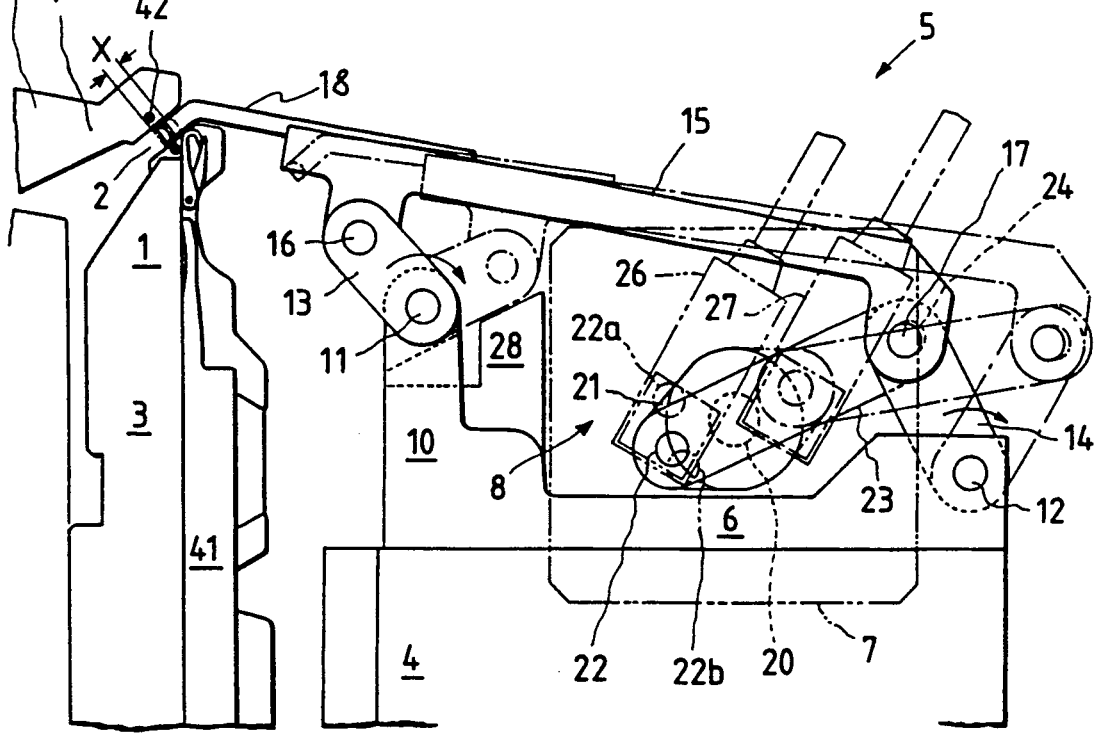
FIG. 2 is a left-hand side elevational view.

As shown in FIG. 2, the rocking arm 13 makes a crank motion around a fulcrum provided by the shaft 16 together with the presser bar supporting arm 15, but when, at the retracted position of the presser bar 18, some external force is applied from below to above with respect to a longitudinal direction of the presser bar supporting arm 15, the rocking arm 13 may be moved to a position near or beyond a dead point due to the damping action described above, and there is the possibility that a crank motion may not be performed any more. A stopper 28 is provided to prevent such possibility.

The brush supporting member 9 is constituted in the following manner.

A gear 32 which meshes with another gear 31 secured to the motor shaft 20 is supported on a shaft 33. A rod 35 which is held in engagement with an eccentric cam 34 provided in an integral relationship with the gear 32 and a rocking arm 37 supported on a shaft 36 implanted on the base plate 6 are connected to each other by way of a shaft 38. A brush holder 39 is provided in an integral relationship at a top portion of the rocking arm 37 and holds a brush 40 thereon. The brush 40 is arranged at an end thereof in parallel to the needle bed spacing portion 2 and the straight portion 19 of the presser bar. The brush 40 is called a clearing brush. it sweeps away the latch 101 of the needle 100 so that the latch, a movable piece, is lowered and the latch needle is opened.

Figure 3:
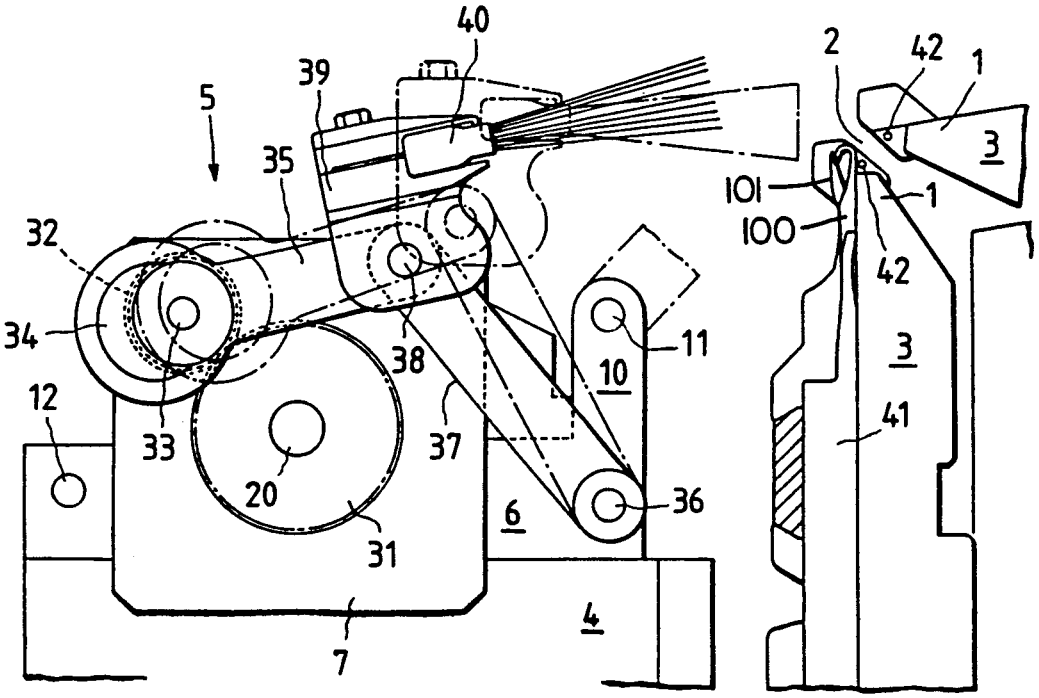
FIG. 3 is a right-hand side elevational view.

In the foregoing description, the gear ratio between the gears 31 and 32 is 2:1, and when the presser bar 18 is moved from the retracted position to the advanced position or from the advanced position to the retracted position, the brush 40 is moved from an advanced position to a retracted position or from the retracted position to the advanced position. Since an operative position of the brush 40 is designed such that it may assume a dead point as shown in FIG. 3, even if a pressure by a needle upon knitting is applied to the brush 40, the brush 40 is not retracted.

It is assumed now that knitting of a knit fabric is being carried out. In this instance, the straight portion 19 of the presser bar is advanced into the needle bed spacing portion 2 as shown in FIG. 2 so that it presses down the knit fabric (not shown) knit by the needles 41 and held on wires 42. Such advancement of the presser bar 18 to the position is carried out by rotation of the motor 7, and such rotation is transmitted to the presser bar supporting arm 15 by way of the crank arm 21, shaft 22, rod 23 and shaft 17 so that the presser bar supporting arm 15 advances the straight portion 19 of the presser bar 18 at the end thereof into the needle bed spacing portion 2. The most advanced position then is obtained when the shaft 22 is displaced by rotation of the crank arm 21 until it is opposed to the proximity sensor 26, and the motor 7 stops its rotation in response to a signal developed from the proximity sensor 26 then. On the contrary, when the presser bar 18 is to be retracted, the motor 7 is rotated reversely to that described above, and when the shaft 22 of the crank arm is opposed to the proximity sensor 27, rotation of the motor 7 is stopped.

The movement of the brush 40 toward and away from the needle bed spacing portion 2 is carried out in the following manner.

When the motor shaft 20 is rotated, the eccentric cam 34 is rotated by way of the gears 31, 32 so that the rod 35 is advanced. Such advancement is to advance the brush holder 39 supported at the top portion of the rocking arm 37 supported on the shaft 36 toward the needle bed spacing portion 2, and retraction is reverse to that.

According to the present invention, a fabric presser for a V-bed flat knitting machine comprises, as described hereinabove, a presser bar, a presser bar supporting arm having the presser bar at an end thereof, a support member having the presser bar supporting arm supported for rocking motion by way of a rocking member such that the presser bar may be moved toward and away from a needle bed spacing portion of the knitting machine, and a motor mounted on the supporting member for rocking the rocking member. Accordingly, even when knitting is performed over an overall length of needle beds, if the motor is driven in response to a signal at a position of an end portion in knitting of a knit fabric, then a stitch presser which has been at its operative position in a course till then can be drawn up while another stitch presser for the knitting of a new course can be moved down to an operative position.

Accordingly, in the apparatus of the present invention, abutment levers to be disposed outside a carriage are unnecessary, and such waste that the carriage must be moved despite that it does not knit a knit fabric such that the carriage is moved to an end portion of the needle beds to perform changing over by an abutment lever as in a conventional apparatus can be eliminated, and the knitting efficiency can be improved.

Then, since the advanced position of the stitch presser into the needle bed spacing is controlled by the stepping motor, an arbitrary advanced position, that is, an arbitrary knit fabric pressing down position, can be obtained by changing the number of steps of the motor, and even for the knitting of a knit fabric having different knitting parameters, a conventional cumbersome adjusting operation can be omitted and can be copied with rapidly. Further, even in a flat knitting machine of multi-knitting systems, a changing over operation of the stitch presser independent in each knitting system is made possible by disposing a motor for each knitting system, and operative and inoperative conditions of them can be selected arbitrarily. Consequently, it is also possible to adopt a more effective knitting method.

What is claimed is:

1. A fabric presser for a V-bed flat knitting machine, comprising a presser bar, a presser bar supporting arm having the presser bar at an end thereof, a support member having said presser bar supporting arm supported for rocking motion by way of a rocking member such that said presser bar may be moved toward and away from a needle bed spacing portion of said knitting machine, and a motor mounted on said support member for rocking said rocking member, said presser bar supporting arm being supported for a pivotal motion by means of a third shaft and a fourth shaft, respectively, at ends of first and second rocking arms which are supported on the support member by means of a first shaft and a second shaft.

2. A fabric presser as claimed in claim 1, wherein said rocking member comprises a crank arm of a motor shaft of the motor and a rod which is supported for pivotal motion by a fifth shaft on the crank arm and is connected to the fourth shaft of the second rocking arm.

3. A fabric presser as claimed in claim 2, wherein a fitting portion of the rod on the fourth shaft has an elongated hole formed therein so as to provide a loose condition, and a spring is interposed between the fourth shaft and the fifth shaft.

4. A fabric presser as claimed in claim 3, wherein first and second proximity sensors are provided at locations opposing to a locus of rotation of the fifth shaft provided at an end portion of the crank arm so that notion is detected by the proximity sensors when the presser bar is advanced into an appropriate range for a knitting operation and when the presser bar is retracted into an appropriate range for a knitting operation.

5. A fabric presser as claimed in claim 4, wherein said motor is a stepping motor and the appropriate moving range of the presser bar may be obtained by varying the number of pulses of the stepping motor.

* * * * *